US011555224B2

(12) United States Patent
Graf et al.

(10) Patent No.: US 11,555,224 B2
(45) Date of Patent: Jan. 17, 2023

(54) PRODUCING A PARTIALLY HARDENED FORMED PART

(71) Applicant: weba Werkzeugbau Betriebs GmbH, Dietach/Steyr (AT)

(72) Inventors: Johannes Graf, Kleinraming (AT); Klaus Weber, Haidershofen (AT)

(73) Assignee: WEBA WERKZEUGBAU BETRIEBS GMBH, Dietach/Steyr (AT)

( * ) Notice: Subject to any disclaimer, the term of this patent is extended or adjusted under 35 U.S.C. 154(b) by 399 days.

(21) Appl. No.: 16/740,587

(22) Filed: Jan. 13, 2020

(65) Prior Publication Data

US 2020/0149125 A1 May 14, 2020

Related U.S. Application Data

(62) Division of application No. 15/076,919, filed on Mar. 22, 2016, now Pat. No. 10,584,395.

(30) Foreign Application Priority Data

Mar. 26, 2015 (EP) ..... 15161040

(51) Int. Cl.
*C21D 1/06* (2006.01)
*C21D 9/48* (2006.01)
(Continued)

(52) U.S. Cl.
CPC ..... *C21D 1/06* (2013.01); *B21D 22/022* (2013.01); *B21D 24/16* (2013.01); *B21D 35/001* (2013.01);
(Continued)

(58) Field of Classification Search
CPC . C21D 1/06; C21D 1/18; C21D 1/673; C21D 8/005; C21D 8/0294; C21D 8/0405;
(Continued)

(56) References Cited

U.S. PATENT DOCUMENTS 8,261,591 B2 9/2012 Hielscher
9,687,898 B2 6/2017 Loesch
(Continued)

FOREIGN PATENT DOCUMENTS

CN 102198465 A 9/2011
CN 203417995 U 2/2014
(Continued)

OTHER PUBLICATIONS

English translation of CN-103934360-A. Year: 2014 (Year: 2014).*

*Primary Examiner* — Anthony J Zimmer
*Assistant Examiner* — Nazmun Nahar Shams
(74) *Attorney, Agent, or Firm* — Bejin Bieneman PLC

(57) ABSTRACT

A process of producing a partially hardened metallic formed part comprises: heating a semi-finished product of hardenable hot-formable steel sheet to a hardening temperature; hot-forming the heated semi-finished product in a combined hot-forming cutting device into a three-dimensional formed part; cutting the formed part in the combined hot-forming cutting device; pressure-hardening the formed part in the hot-forming cutting device into a hardened formed part such that a first partial region is hardened by rapid cooling and that a second partial region of the formed part is heat-treated so as to comprise a greater ductility and a lower strength than the first partial region, wherein the operation of cutting the formed part takes place at least in one of the first and second partial region. A combined hot-forming cutting device can be used to produce a metallic formed part.

12 Claims, 4 Drawing Sheets

(51) Int. Cl.

| | |
|---|---|
| ***B21D 53/88*** | (2006.01) |
| ***C21D 1/673*** | (2006.01) |
| ***C21D 8/04*** | (2006.01) |
| ***B21D 24/16*** | (2006.01) |
| ***B21D 22/02*** | (2006.01) |
| ***C21D 8/02*** | (2006.01) |
| ***C21D 1/18*** | (2006.01) |
| ***B21D 35/00*** | (2006.01) |
| ***C21D 8/00*** | (2006.01) |
| ***C21D 9/00*** | (2006.01) |

(52) U.S. Cl.
CPC ..... *B21D 53/88* (2013.01); *C21D 1/18* (2013.01); *C21D 1/673* (2013.01); *C21D 8/005* (2013.01); *C21D 8/0294* (2013.01); *C21D 8/0405* (2013.01); *C21D 9/0068* (2013.01); *C21D 9/48* (2013.01); *C21D 2221/00* (2013.01)

(58) Field of Classification Search
CPC .... C21D 9/0068; C21D 9/48; C21D 2221/00; B21D 22/022; B21D 24/16; B21D 35/001; B21D 53/88; B21D 22/208; B21D 35/00; B21D 22/26; B21D 37/16
See application file for complete search history.

(56) References Cited

U.S. PATENT DOCUMENTS

| | | | |
|---|---|---|---|
| 2008/0295563 | A1 | 12/2008 | Terziakin |
| 2014/0096583 | A1 | 4/2014 | Cho |
| 2014/0137619 | A1 | 5/2014 | Asano |
| 2015/0027601 | A1 | 1/2015 | Sommer |
| 2015/0075246 | A1 | 3/2015 | Dorr |
| 2016/0114373 | A1 | 4/2016 | Iwano |

FOREIGN PATENT DOCUMENTS

| | | | |
|---|---|---|---|
| CN | 103934360 | A | 7/2014 |
| CN | 203991969 | U | 12/2014 |
| DE | 102005032113 | B3 | 2/2007 |
| DE | 102006015666 | A1 | 10/2007 |
| DE | 102006026805 | A1 | 1/2008 |
| DE | 102010011368 | A1 | 9/2011 |
| DE | 102011120725 | A1 | 6/2012 |
| DE | 102012002468 | A1 | 8/2013 |
| EP | 1715066 | A1 | 10/2006 |
| EP | 2583769 | A1 | 4/2013 |
| JP | H07-47431 | A | 2/1995 |
| JP | 2002178069 | A | 6/2002 |
| JP | 2005205416 | A | 8/2005 |
| JP | 2011523375 | A | 8/2011 |
| WO | 2012160699 | A1 | 11/2012 |
| WO | 2012161192 | A1 | 11/2012 |

* cited by examiner

PRODUCING A PARTIALLY HARDENED FORMED PART

CROSS-REFERENCE TO RELATED APPLICATIONS

This application is a divisional of, and claims priority to, U.S. patent application Ser. No. 15/076,919 filed Mar. 22, 2016, which claims priority to European Application No. EP15161040.9, filed on Mar. 26, 2015, which applications are hereby incorporated herein by reference in their entireties.

BACKGROUND

From DE 10 2005 032 113 B3 there is known a process of and a device for hot-forming and partially hardening a component between two tool halves in a press. The tool halves are each divided into a plurality of segments which are separated from one another by a thermal insulation. The two segments can be heated or cooled by controlling the temperature, so that temperatures and cooling curves can be set in different regions of the component.

EP 1 715 066 A1 proposes a device for forming and pressure hardening sheet metal. Heating elements are integrated into a forming tool in order to heat the sheet metal in certain regions in the forming tool and to influence the material structure by specific tempering operations. The heating elements are heat-protected relative to the adjoining walls of the forming tool by an insulating layer.

From DE 10 2006 015 666 A1 there is known a process of producing a metallic formed component by hot-forming combined with a simultaneous cutting operation. For this purpose, use is made of a combination tool with an upper tool fixed to a pressure ram, a die supported via force elements on the table of a press and a cutting tool fixed on a cutting punch. The cutting punch is arranged at the edge or in a recess of the die. Cutting takes place at a temperature ranging between 400° C. and 700° C.

Formed parts, more particularly if used as structural components of motor vehicles, have to have different, sometimes contradictory, technical features. Thus, in some regions, formed parts have to feature a high degree of hardness and strength and low ductility values, whereas, in other regions they have to comprise low hardness and strength values and high ductility values. This results in the requirement of producing formed parts with a near-net-shape and specific material characteristics.

SUMMARY

Disclosed herein is a process of producing partially hardened formed parts which process can be carried out simply and quickly and which allows the formed parts to have a near-net-shape. Further disclosed is a device which permits the production of hardened formed parts with a high degree of accuracy and short cycle times.

Thus, disclosed herein is a process of and device for producing a partially hardened formed part, more particularly for being used as a structural component of a motor vehicle.

A process of producing a partially hardened metallic formed part, is provided, comprising the following process steps: heating a semi-finished product consisting of hardenable hot-formable sheet steel to a hardening temperature; hot-forming the heated semi-finished product in a combined hot-forming cutting device into a three-dimensional formed part; cutting the formed part in the combined hot-forming cutting device; pressure-hardening the formed part in the hot-forming cutting device into a hardened formed part such that a first partial region is hardened by rapid cooling and that a second partial region of the formed part is produced by being heated so as to comprise a greater ductility and a lower strength than the first partial region, wherein the cutting the formed part takes place in at least one of the first partial region and of the second partial region.

An advantage of said process is that it is possible to hot-form, cut and pressure-harden formed parts in one process stage. There is no need for a subsequent operation consisting in a separate cutting operation in a separate cutting tool. Undesirable changes in respect of shape and structure of the formed parts can be minimised. It is possible, in a simple way, to produce a formed part with a near-net shape with the desired material properties. "At least one of the first and of the second partial region" means that the step of cutting the formed part can take place in the first partial region and/or in the second partial region.

Heating a part to the hardening temperature can take place such that the entire starting component is heated or, partially, only the partial regions to be hardened. In this disclosure, "hardening temperature" shall refer to a temperature of the semi-finished product or of the component, which temperature is the minimum temperature required for subsequently hardening the component by rapid cooling (quenching). In the case of austenite-forming steels, the minimum hardening temperature would be the austenitising temperature, for example. Rapid cooling (quenching), more particularly, takes place below the critical cooling temperature, so that a martensitic hardness structure is formed.

The step of cutting the formed part can take place at least in a second partial region which is heat-treated and thus has a softer structure than the hardened first portion. This is advantageous in that the cutting is easier to carry out, and the cutting tool is subjected to only a small amount of wear. Within the context of this disclosure, the wording "at least a first, respectively, a second partial region" shall include that the formed part can comprise one or several first partial regions and one or several second partial regions. It is proposed that at least one of the softer second partial regions is cut, while it is not excluded that further second partial regions can remain uncut; and/or that also one or several first partial regions are partially or completely cut prior to the pressure hardening operation. As far as it is referred to one, an or the first partial region or one, an or the second partial region, this is meant in the sense of at least one of the respective partial regions.

The starting material, also referred to as semi-finished product, for the formed part to be produced therefrom, can be, more particularly, a blank of steel sheet. The blank can comprise a uniform or variable sheet thickness along its length and/or its width. A blank with a variable sheet thickness can be produced for instance by flexible rolling of strip material and by subsequently cutting the blank out of the flexibly rolled strip material, or by welding together pieces of blanks with different sheet thicknesses.

According to an embodiment, the semi-finished product, respectively the component, is heated in an edge-sided second partial region during the hot-forming process. This means that at least one of the softer second partial regions forms an edge zone of the formed part, which edge zone is cut during the combined hot-forming, cutting and pressure hardening process. In this way, the formed part obtains its end contour, so that there is no need for a separate cutting process. The second partial region can be subjected to an air flow during and/or after the hot-forming process. Alternatively or additionally, this also applies for the first partial region to be hardened which, at least partially, can be subjected to an air flow. Subjecting the first partial region to be hardened with a brief air flow has the purpose to prevent an excessive reduction in the wall thickness as a result of high temperatures.

According to an embodiment, the combined hot-forming cutting device can comprise at least one upper tool part and at least one lower tool part which are closed for the purpose of hot-forming the component, with the cutting operation taking place, more particularly during or after the closing of the tool parts. The tool parts can be closed by moving only one of the two tool parts whereas the other one remains fixed in its position, or by moving the two tool parts towards each other. For hot-forming, the semi-finished product which is heated to its hardening temperature at least in partial regions, is inserted between the upper and the lower tool part. While the two tool parts are being pressed together, the contour of the forming tool is transferred to the semi-finished product, which is thus formed into the formed part. If the to be hardened first partial regions have to be cut, the cutting operation can take place before the tool parts are completely closed. The second partial regions comprising a higher ductility can, in principle, be cut at any time, i.e., prior to, during and/or after the closing operation, i.e., after having been closed completely. As a result of the tool parts having been closed completely, which corresponds to the end of the pressure stroke, the second partial regions come into planar contact with the formed part, so that the first partial region is cooled quickly and thus hardened. The second partial region is heated during the forming and pressing operation in the tool. For this purpose, at least one of the tool parts comprises a suitable tempering device by which the tool can be heated in the portion coming into contact with the second partial region of the formed part.

After the tool parts have been closed, the second partial region of the formed part can be held at a defined temperature which, more particularly, ranges between 300° C. and 600° C. The holding time for the formed part held between the closed tool parts can range between 0.5 seconds and 360 seconds. At the end of the pressing stroke, i.e., when the component has at least largely been formed, the second partial region is cut. The formed part has its end contour and can be removed from the device after the tool parts have been opened again. After the tool parts have been opened, air can be blown against the second partial region of the formed part. To prevent the tempered tool part from overheating, it is possible to provide a further process step in that one or several tool parts are temporarily or permanently cooled, i.e., during and/or after the hot-forming. This can apply to the heated second tool portion and to the first tool portion.

Furthermore, a hot-forming cutting device can be provided for producing metallic formed parts, comprising an upper tool part, a lower tool part, wherein the upper tool part and the lower tool part can be closed for forming a semi-finished product inserted between the upper tool part and the lower tool part into a formed part, wherein at least one of the upper tool part and of the lower tool part comprises a first tool portion which, during the closing, comes into contact with a first partial region of the semi-finished product, wherein the first tool portion comprises a first tempering device by which the first tool portion can be set to a first temperature, wherein at least one of the upper tool part and of the lower tool part comprises a second tool portion which, during the closing, comes into contact with the second partial region of the semi-finished product, wherein the second tool portion comprises a second tempering device by which the second tool portion can be set to a second temperature which is higher than the first temperature of the first tool portion, wherein at least one of the upper tool part and/or the lower tool part comprises at least one cutting tool in at least one of the first tool portion and of the second tool portion, which cutting tool is configured to cut the formed part in the respective first and/or second partial region.

Said device achieves the same advantages as those already mentioned in connection with said process. More particularly, the device enables formed parts to be hot-formed, cut and partially hardened in one process stage. The device permits the production of a near-end-contour formed part comprising the desired material properties. It is to be understood that the process and the device belong together in that all the process-related features can be applied to the device and, vice versa, all the device-related features can be applied to the process. A formed part produced by the device, respectively by the process, is particularly suitable for being used as a structural component for a vehicle body or vehicle chassis.

It is proposed that the first tempering device is designed for rapidly cooling the first tool portion such that the formed part is hardened in the first partial region. For this purpose, the first tempering device can comprise a cooling channel assembly through which there flows a cooling medium. The cooling channels extend through the tool in such a way that the tool surface coming into contact with the first partial region is cooled. The cooling medium can be water, for example. Furthermore, it is proposed that the second tempering device is designed for heating the second tool portion, so that the formed part obtains a higher degree of ductility in the second partial region than in the first partial region. The second tempering device can comprise one or more heating cartridges which can be arranged in suitable cavities of the second tool portion. The heating cartridges are arranged in those regions of the tool in which the component shall obtain a higher degree of ductility by being heated, with the heat of the heating cartridges being transferred to the tool and from there to the component.

In addition to the tempering device for heating the tool, a cooling assembly for cooling purpose can be provided in the second tool portion, through which cooling assembly a fluid can be passed through. In this way it is possible to prevent the tool from overheating. It is to be understood that such a channel arrangement can also be provided in the first tool portion. The first and the second tool portion each comprise at least one forming face which comes into contact with the component during the closing, wherein at least some of the channels of the channel assembly can be designed such that they end in one of the forming faces. In this case the fluid used can be air which can be blown against the component. In this way, the formed part is cooled, with the air, at the same time, having a cooling effect on the tool. According to another embodiment it is also possible that the cooling channels do not end in the forming face, but merely extend inside the tool at a distance from the surface. In this case, the cooling channels, more particularly, can be arranged at a deeper distance from the tool surface than parts of the tempering device for heating the tool.

According to an embodiment, a second tool portion and a first tool portion can be separated from one another by an insulating material or by a gap. In the latter case, the gap has an insulating effect between the two tool portions, so that, regarding the temperature to be set, these cannot influence one another in a disadvantageous way. Alternatively or additionally, a first and a second tool portion can adjoin one another directly, i.e., without a gap therebetween.

In principle, a cutting tool for cutting the formed part can be arranged anywhere in the hot-forming cutting device where cutting the formed part is required. More particularly, a cutting tool can be arranged in an edge region of the first and/or the second tool portion, so that a projecting edge of the formed part is cut off. In this way, the formed parts can be produced in the combined hot-forming cutting device in an advantageous way with a near-end-contour. It is understood that a further cutting tool can also be arranged in a central region of the formed part to be produced, i.e., at a distance from the edge, for example, for producing through-apertures or bores in that region.

More particularly, a cutting tool of the hot-forming with cutting device can comprise a cutting punch which is connected with one of the upper or lower tool parts, and a cutting die which is connected to the other one of the upper and lower tool parts, as well as a space for the sheet blank waste. In respect of the movement mechanics for the hot-forming cutting process, the hot-forming cutting device is designed such that cutting takes place prior to pressure hardening the formed part. For this purpose, the cutting tool can carry out the cutting operation at the formed part before the formed part is cooled as a result of a complete, planar contact with the cooled tool parts. This embodiment allows the hardened component to be cut in a cost-saving and energy-saving way.

SUMMARY OF THE DRAWINGS

Example embodiments of the invention will be explained below with reference to the Figures.

DESCRIPTION

FIGS. 1 to 7 will be described jointly below.

Figure 1:
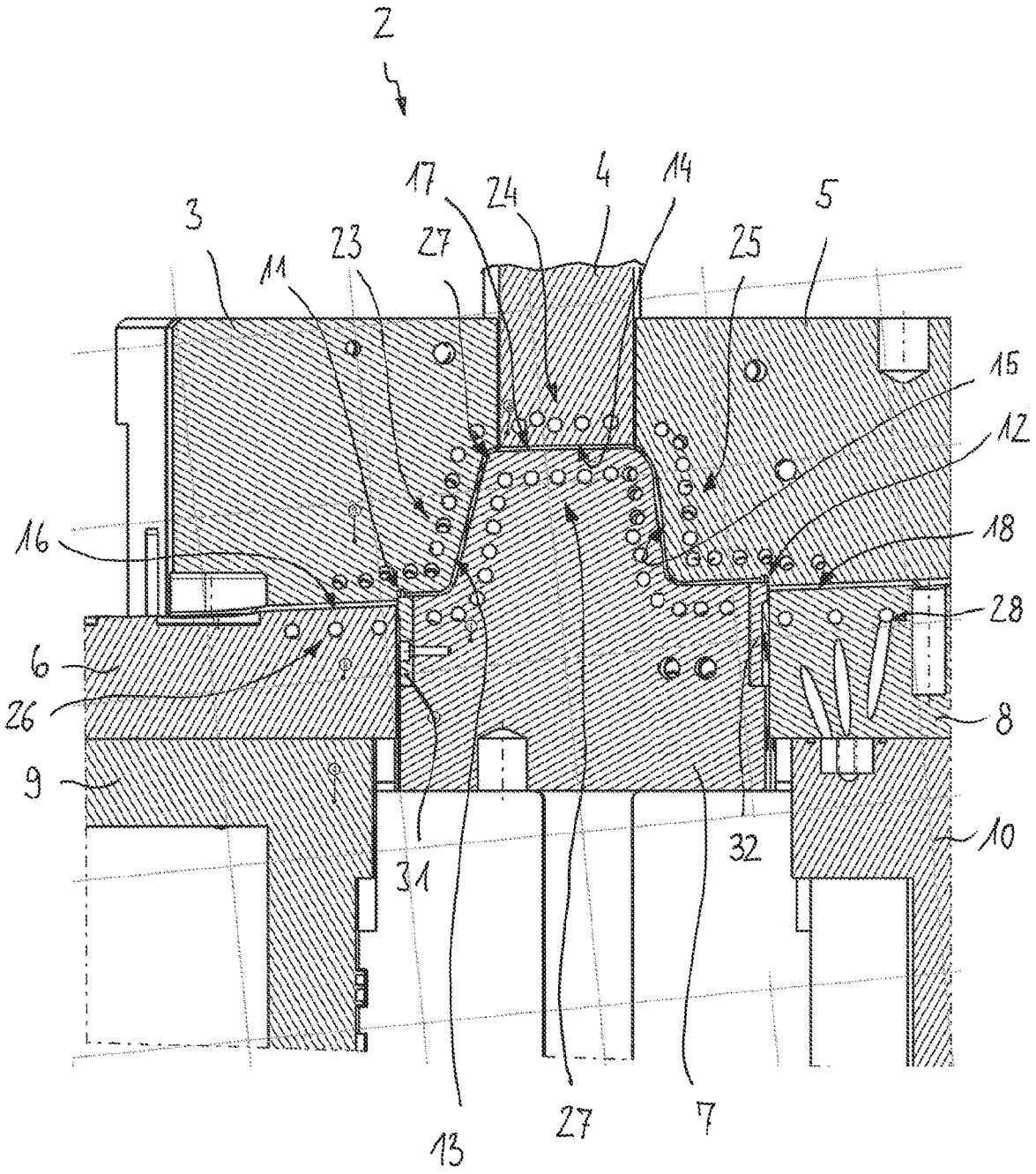
FIG. 1 shows an example hot-forming cutting device for producing a metallic formed component in a first embodiment.
Figure 2:
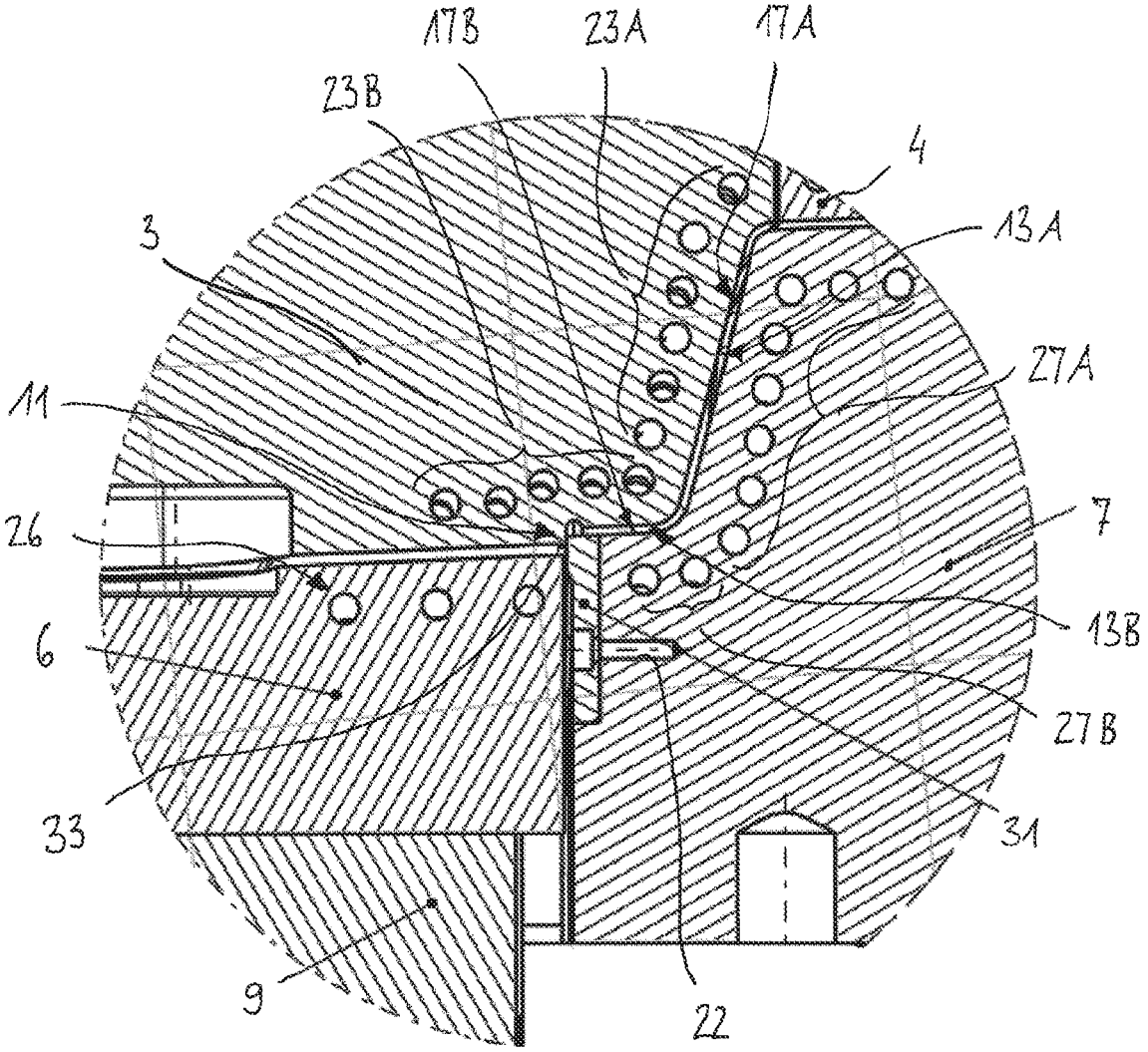
FIG. 2 shows a detail of the hot-forming cutting device according to FIG. 1 in an enlarged illustration.
Figure 3:
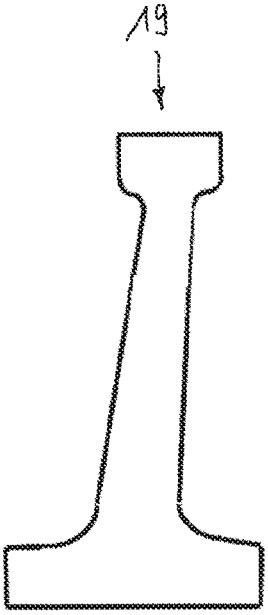
FIG. 3 is a plan view of a starting component.

FIGS. 1 and 2 show a cross-section through a hot-forming cutting device 2 for producing a three-dimensional metallic formed part. The starting material for producing a three-dimensional formed part 20 is a semi-finished product 19, more particularly a blank of steel sheet which can also be referred to as a form cut or planar component.

The semi-finished product 19 can be produced from strip material of steel sheet. The strip material can be obtained by rolling after previously having been heated, which is also referred to as an hot (rolled) strip, and/or the strip material can be cold-rolled, with the final removal of thickness being achieved by rolling without prior heating, which is also referred to as a cold (rolled) strip. The semi-finished product to be formed can comprise a uniform sheet thickness along its length and/or along the width of the component respectively. It is also possible for the semi-finished product to comprise regions of different thicknesses which can be produced in different ways, for example by flexible rolling (Tailor rolled blanks), strip profile rolling or by welding individual sheet plates with different sheet thicknesses (Tailor welded blanks).

In the case of flexible rolling, strip material with a substantially uniform sheet thickness is rolled by changing the roll gap during the process of producing the strip material with a variable sheet thickness along the length of the material. The portions with different thicknesses produced by flexible rolling extend transversely to the longitudinal direction and to the direction of rolling respectively. In the case of strip profile rolling, sheet metal material, i.e., strip material or individual sheet metal elements, having a substantially uniform thickness is rolled through a roll profile into sheet metal material with a variable thickness along the width of the material. The portions with different thicknesses produced by strip profile rolling extend along the longitudinal direction of the sheet metal material. In the case of strip profile rolling, which is also referred to as roll profiling, individual regions of the sheet metal material are quenched towards the outside.

Figure 4:
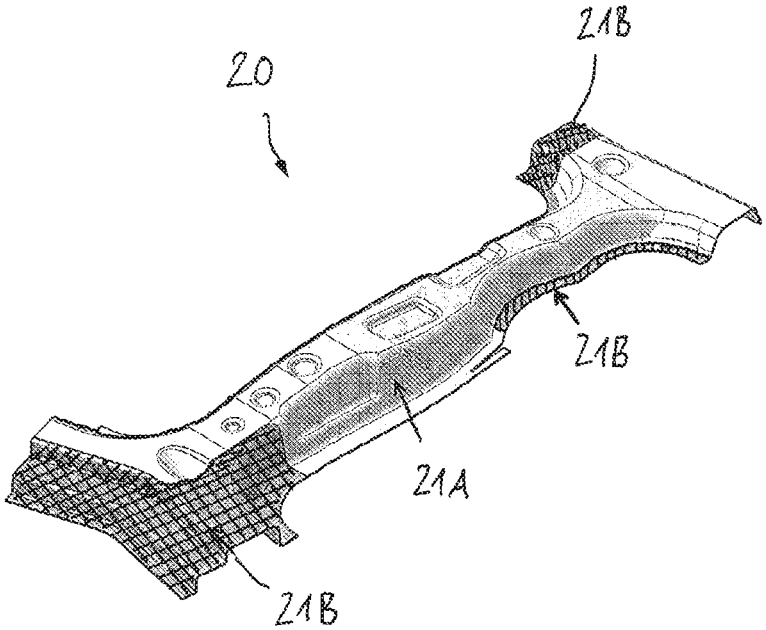
FIG. 4 shows a formed part in the form of a B-column produced from a starting component according to FIG. 3.

The hot-forming cutting device 2 is suitable for further processing blanks 19, produced by any method, into the formed part 20. The specific design of the hot-forming cutting device 2 depends on the contour of the formed part to be produced. The device 2 shown here serves to produce a formed part for the B-column of a motor vehicle. A profile cut part 19 for producing the B-column is shown in a plan view in FIG. 3. The three-dimensional B-column 20 produced from a planar profile cut part 19 is shown in FIG. 4. In a cross-sectional view the B-column has an approximately hat-shaped profile.

The hot-forming cutting device 2 shown for producing the B-column comprises a plurality of upper tool parts 3, 4, 5 and a plurality of lower tool parts 6, 7, 8 between which the planar semi-finished product is inserted and is shaped into a three-dimensional formed part by moving of the upper tool parts 3, 4, 5 relative to and towards the lower tool parts 6, 7, 8. The lower tool parts 6, 7, 8 are fixed on carrier elements 9, 10.

Furthermore, the hot-forming cutting device 2 comprises a plurality of cutting tools 11, 12 which are designed so as to cut and shape the formed part 20. The cutting tools 11, 12 each comprise a blade 31, 32 and a counter blade 33, 34 which cooperate while the device is being closed for cutting off the projecting part of the formed part. The blades and counter blades, which can also be referred to a cutting punch and cutting die, can be produced from a hardened material. It can be seen that the blades 31, 32 are each arranged in lateral recesses of the lower tool part 7 and are fixedly connected thereto. This is achieved, for example, by threaded connections as indicated by the boreholes 22 in the tool part 7, with other commonly used types of connection also being possible.

The upper tool parts 3, 4, 5, and the lower tool parts 6, 7, 8 each comprise tool portions 13, 14, 15; 16, 17, 18 which are located close to the surface and which, when closing the tool, come into contact with the semi-finished product. By closing the upper tool parts relative to the lower tool parts, the planar sheet bar positioned therebetween is formed into a three-dimensional formed part 20. Relative to the form-giving (shaping) tool portions, the cutting tools 11, 12 are arranged such that the cutting operation takes place when the semi-finished product 19 has already been largely formed into the formed part 20, but before the device 2 has been fully closed, i.e., before the formed part 20 has been pressure hardened upon having complete surface contact with the tool parts.

There are provided tempering devices 23, 24, 25; 26, 27, for tempering the tool portions close to the surface; tempering in the context of the present disclosure in particular refers to setting the respective tool portion to a certain temperature which can be cooling and/or heating. It is proposed that at least one of the upper or lower tool parts 3, 4, 5, 6, 7, 8 comprises two different tempering devices such that a first tempering device of the tool part is designed for cooling and a second tempering device for heating the respective tool part.

This will be explained exemplary with reference to the upper tool part 3 whose tempering device 23 comprises a first tempering part 23A which serves for specifically cooling the associated first tool portion 13A to a first temperature T1, and a second tempering device 23B which serves to heat the associated second tool portion 13B to a second temperature T2 which is higher than the first temperature T1. The first temperature T1 for the first tool portion 13A is set such that the formed part 20, is hardened in this region, during the pressing process between the upper tool parts 3, 4, 5 and the lower tool parts 6, 7, 8. Due to the first tool portion 13A cooled to the first temperature T1, the component 19, starting from the hardening temperature, is cooled so rapidly with a critical cooling speed that a material structure comprising a high degree of hardness and high strength respectively is achieved.

In contrast, the second tool portion 13B is heated to the second temperature T2 which can range between 300° C. and 600° C., for example. By heating the second tool portion 13B, the formed part 20, in this region, is provided with a higher degree of ductility and a lower strength than in the hardened first region. In accordance with the required structure properties of the formed part 20, the lower tool parts 6, 7, 8 are designed to correspond to the upper tool parts 3, 4, 5. That is, the first tool portion 17A of the lower tool part 7, which is positioned opposite the cooled first tool portion 13A of the upper tool part 3, is also cooled, whereas the second tool portion 17B of the lower tool part 7 arranged opposite the cooled second tool portion 13B of the upper tool part 3 is also heated.

The first tempering devices 23A, 27A of the upper tool part 3 and of the lower tool part 7 each comprise a cooling channel assembly with several cooling channels which can be passed through by a cooling medium. The cooling channels extend in such a way through the upper tool part 3 and the lower tool part 7, respectively, that the tool surface coming into contact with the partial region 21B of the semi-finished product to be cooled, respectively, of the component 19 produced therefrom, is cooled. The cooling medium can be water, for example.

The second tempering devices 23B, 27B, which serve to heat the second tool portions 13B, 17B, can be used in the form of heating cartridges which are inserted into suitable hollow spaces of the second tool portions. The heat of the heating cartridges is thus transferred to the second tool portions 13B, 17B and from there to the semi-finished product, respectively the component 19 produced therefrom, which is positioned between the tool portions 13B, 17B.

It can be seen that the cutting tool 11 is arranged in the region of the heated second tool portions 23B, 27B of the upper and lower tool parts 3, 7. The operation of cutting the formed part 20 thus takes place in a partial region 21B which, due to having been heated, comprises a greater ductility than in the cooled partial regions 21A. This is advantageous in that in this heated region, the cutting tool 11, 12 is subjected to a small amount of wear only. However, it is understood that one or several further cutting tools can be provided also in those tool portions which are designed for pressure hardening the formed part, which, however, is not critical for the wear of the cutting tool in that the cutting operation during the pressure application stroke, in terms of time, takes place prior to the tool parts 3, 4, 5, 6, 7, 8 fully coming into planar contact with the component, and thus prior to the formed part being hardened.

The holding time for the formed part 20 between the fully closed tool parts 3, 4, 5, 6, 7, 8 can range between 0.5 seconds and 360 seconds. After the holding time has been reached, the formed part 20 comprises its end contour and the required structure, and can be removed from the device after the tool parts 3, 4, 5; 6, 7, 8 have been opened again.

Figure 5:
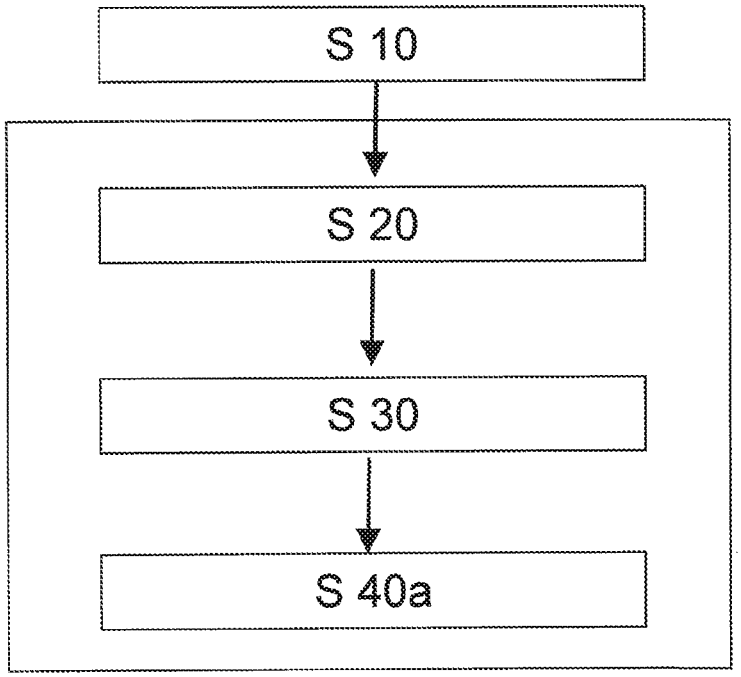
FIG. 5 shows an example process for producing a metallic formed part.

The process of producing a partially hardened metallic formed part 20 with a hardened first partial region 21A and a ductile second partial region 21B thus comprises the following process steps, as diagrammatically illustrated in FIG. 5: first, heating the semi-finished product 19 which is produced from a hardenable hot-formable steel sheet, at least in the first partial region 21B to a hardening temperature (stage S10). This can be achieved by induction heating for example or in a furnace. Subsequently, the semi-finished product 19 is hot-formed in the combined hot-forming plus cutting device 2 into a three-dimensional formed part 20 (stage S20). Once the semi-finished product has been at least largely formed into the formed part 20, the formed part 20 is cut in the hot-forming plus cutting device 2 (stage S30). In a further process stage (S40), the formed part 20 is pressure hardened in the hot-forming cutting device 2 in such a way that a first partial region 21A is hardened by rapid cooling, and that a second partial region 21B of the formed part 20 is produced with a greater ductility and lower strength than the first partial region 21A by being heated. Subsequently, the component 19 is cut in the hot-forming cutting device 2, at least in the second partial region 21B, by the cutting tool 11, which, time-wise, can occur prior to the hardening. In order to prevent the heated tool parts from overheating, it is possible to provide a further process stage in that said tools parts are temporarily or permanently cooled.

A formed part 20 in the form of a B-column produced in the hot-forming cutting device 2 in accordance with said process is shown in FIG. 4. Said B-column or formed part 20 comprises regions 21B with a greater ductility and a lower strength which are darkened in the drawing; there is also shown a hardened region 21A having an increased strength and a lower ductility. At least part of the regions 21B have been hot-cut. It is understood that this embodiment is only shown by way of example and that the concrete embodiment of the formed part 20 depends on the respective technical requirements.

Figure 6:
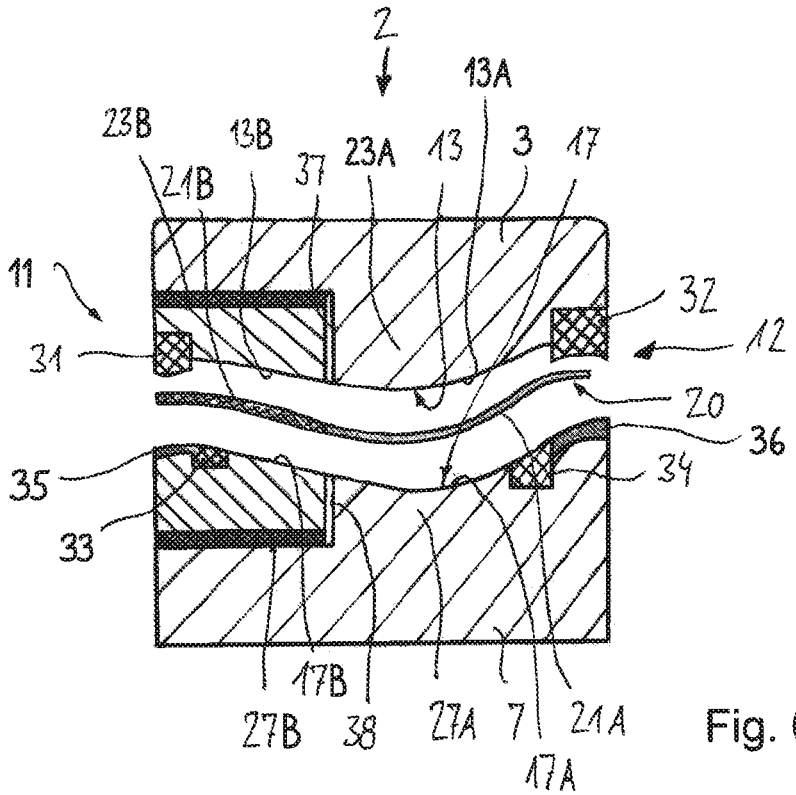
FIG. 6 is a diagrammatic illustration of an example hot-forming cutting device for producing a metallic formed part in a second embodiment.

FIG. 6 shows a hot-forming with cutting device 2 in a modified embodiment which largely corresponds to the embodiment according to FIGS. 1 and 2, so that, as far as common features are concerned, reference is made to the above description. Identical details or details corresponding to one another having been given the same reference numbers as those given in FIGS. 1 and 2.

A difference featured by the present embodiment is that only one upper tool part 3 and one lower tool part 6 is provided, with more than one upper and lower tool part also being possible. The upper tool part 3 and the lower tool part 6 each comprise a first tool portion 13A, 17A which, for the purpose of pressure hardening the formed part 20, is cooled, wherein, for the sake of simplicity, the cooling channels are not shown. Furthermore, the upper tool part 3 and the lower tool part 6 each comprise a second tool portion 13B, 17B, which are each provided with tempering devices 23B, 27B for heating the component 19. In the present embodiment, the tempering devices 23B, 27B are provided in the form of heating plates whose temperature T2 can be set via suitable temperature control means. The heated second tool portions 13B, 17B are insulated relative to the cooled first tool portions 13A, 17A by an insulating material 37, 38 or an air gap.

Furthermore, a cutting tool 11 can be seen in the region of the second tool portions 13B, 17B of the upper and lower tool parts 3, 7. The blade 31 is firmly connected to the upper tool part 3, for example by a threaded connection, and the counter blade 33 is associated with the lower tool part 7, respectively firmly connected thereto. In the edge region of the tool part 7, which edge region laterally adjoins the counter blade 33, a recess 35 is provided which serves as a free space for the cut-off edge of the component 19. Furthermore, a second cutting tool 12 can be seen in the edge region of the cooled first tool portion 13A, 17A of the upper and lower tool parts 3, 7. The blade 32 is fixedly connected to the upper tool part 3, whereas the counter blade 34 is connected to the lower tool part 7. A recess 36 is provided laterally adjacent to the counter blade 34 which recess 36 serving as a free space for sheet blank waste.

In the present embodiment, the operation of cutting the formed part 20 takes place both in a tool portion 13A, 17A cooled for the purpose of hardening the formed part as well as in a tool portion 13B, 17B heated for the purpose of ensuring ductility.

Figure 7:
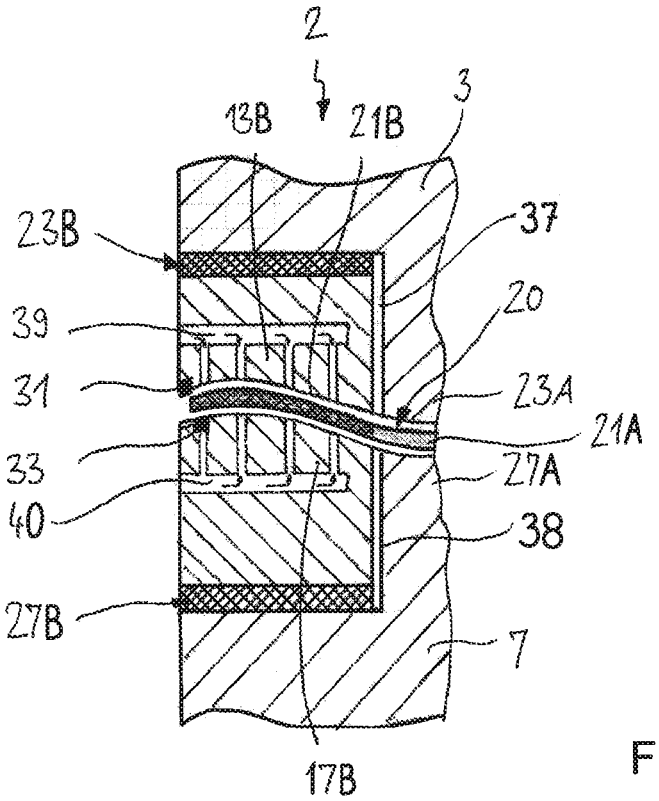
FIG. 7 is a diagrammatic illustration of an example hot-forming cutting device for producing a metallic formed part in a modified embodiment.

FIG. 7 shows a hot-forming cutting device 2 in a further modified embodiment which largely corresponds to the embodiment according to FIG. 6, and to FIGS. 1 and 2 respectively, so that, as far as common features are concerned, reference is made to the above embodiment. Identical details or details corresponding to one another have been given the same reference numbers as in FIG. 6 and FIGS. 1 and 2 respectively.

A special feature of the present embodiment is that the second tool portions 13B, 17B are each provided with a cooling device. The cooling device comprises a channel assembly 39, 40 with a plurality of channels which extend through the second tool portions 13B, 17B and which end in the shaping surface. To that extent, the cooling device comprises two functions, i.e., cooling the second tool portions 13B, 17B in order to avoid overheating, as well as directing an airflow against the component for cooling same after the device has been opened again. The cooling medium is air.

Overall, the device and the process carried out therewith are advantageous in that formed parts can be hot-formed, cut to shape and pressure hardened in one single process stage. There is produced a near-end-contour formed part with the required material properties.

The invention claimed is:

1. A process of producing a partially hardened metallic formed part, comprising:

heating a semi-finished product of hardenable hot-formable steel sheet to a hardening temperature;

hot-forming the heated semi-finished product in a combined hot-forming cutting device into a three-dimensional formed part, wherein the combined hot-forming cutting device comprises an upper tool part and a lower tool part which are closed for hot-forming the semi-finished product;

cutting the formed part in the hot-forming cutting device; and pressure-hardening the formed part in the hot-forming cutting device into a hardened formed part such that a first partial region is hardened by rapid cooling and a second partial region of the formed part is heat-treated so as to obtain a greater ductility and a lower strength than the first partial region;

wherein at least the second partial region of the formed part is subjected to an air flow at least one of during and after the upper tool part and lower tool part are being opened;

wherein, after the air flow, the second partial region still has the greater ductility and the lower strength than the first partial region; and wherein cutting the formed part takes place in at least one of the first partial region and of the second partial region.

2. The process according to claim 1, wherein the cutting takes place while the tool part is being closed and prior to the pressure hardening.

3. The process according to claim 2, wherein, after the upper and lower tool parts have been closed, the semi-finished product is held at a temperature between 300° C. and 600° C. in the second partial region.

4. The process according to claim 2, wherein the upper and lower tool parts are kept closed for a period of 0.5 seconds to 360 seconds.

5. The process according to claim 1, wherein the first partial region of the formed part is subjected to another air flow at least one of during and after the upper tool part and lower tool part are being opened.

6. The process according to claim 2, wherein at least one of the upper tool part and the lower tool part comprises a first tool portion which, during the hot-forming and pressure hardening, contacts the first partial region of the formed part, wherein the first tool portion is cooled to a first temperature such that the first partial region of the formed part is hardened, and further wherein at least one of the upper tool part and of the lower tool part comprises a second tool portion which, during the hot-forming and pressure hardening, contacts the second partial region of the semi-finished product, wherein the second tool portion is heated to a second temperature which is higher than the first temperature of the first tool portion such that the second partial region of the formed part obtains a greater ductility than the first partial region.

7. The process according to claim 6, wherein the first tool portion is cooled at least one of prior to, during and after the hot-forming.

8. The process according to claim 7, wherein the first tool portion is cooled by a cooling medium flowing through a first cooling channel arrangement of the first tool portion.

9. The process according to claim 6, wherein the heating of the second tool portion is conducted by heating a plurality of heating cartridges received in cavities of the second tool portion.

10. The process according to claim 6, wherein the second tool portion is at least temporarily cooled at least one of prior to, during and after the hot-forming.

11. The process according to claim 10, wherein the second tool portion is cooled by an air-containing fluid flowing through a second cooling channel arrangement of the second tool portion.

12. The process according to claim 11, wherein at least some channels of the second cooling channel arrangement end in a forming face of the second tool portion, such that the air-containing fluid flowing through the at least some channels is blown, as the air flow, against the semi-finished product respectively formed part.

* * * * *